United States Patent [19]

Beal et al.

[11] Patent Number: 4,987,952

[45] Date of Patent: Jan. 29, 1991

[54] APPARATUS FOR USE IN DEHUMIDIFYING AND OTHERWISE CONDITIONING AIR WITHIN A ROOM

[75] Inventors: David E. Beal, Augusta; John W. Dumont, Jr., Monmouth; Andrew S. Matthews, Lewiston, all of Me.

[73] Assignee: Dumont Holding Company, Monmouth, Me.

[21] Appl. No.: 514,874

[22] Filed: Apr. 26, 1990

[51] Int. Cl.[5] ..... F24F 3/14

[52] U.S. Cl. ..... 165/16; 62/176.6; 62/203; 62/332; 165/21; 165/28; 165/48.1

[58] Field of Search ..... 62/176.1, 176.6, 203, 62/208, 332; 165/16, 21, 28, 48.1

[56] References Cited

U.S. PATENT DOCUMENTS

| | | | |
|---|---|---|---|
| 2,049,146 | 7/1936 | Wason | 62/203 X |
| 2,461,560 | 6/1946 | Graham et al. | 165/48.1 X |
| 3,139,020 | 6/1964 | Schemenauer | 165/16 X |
| 3,469,412 | 9/1969 | Guiffre | 62/176.6 X |
| 3,540,525 | 11/1970 | Bradshaw et al. | 165/16 |
| 4,023,947 | 5/1977 | Ferry | 62/332 X |
| 4,244,193 | 1/1981 | Haakenson | 62/332 X |
| 4,272,966 | 6/1981 | Niemann et al. | 62/332 X |
| 4,544,023 | 10/1985 | Marcuniak | 165/48.1 |
| 4,848,444 | 7/1989 | Heinle et al. | 62/176.6 X |

*Primary Examiner*—William E. Tapolcai

[57] ABSTRACT

Apparatus for dehumidifying or otherwise conditioning the air in a room has a cabinet housing a pair of units side by side. Each unit is essentially a conventional dehumidifier but has its evaporator and evaporator fan above its condenser, compressor and condenser fan and is separated therefrom to establish an upper evaporator section and a lower condenser section. The cabinet has outside air inlet ports opening into the upper and lower sections with each controlled by adjustable dampers. The cabinet also has a port through which air is discharged to the outside by the condenser fans. Separate conditioned air outlets open from the upper section into the room. In addition, the cabinet has ports in its ends to admit air from the room into the upper and lower sections and these are also provided with adjustable dampers. The control for the apparatus is based on inputs from sensors responsive to the humidity and temperature of the inside and outside air, circulating air and discharged air and they provide outputs controlling the operation of the fans, the compressors and the adjustments of the dampers to establish and maintain suitable room humidity and temperature conditions.

13 Claims, 8 Drawing Sheets

APPARATUS FOR USE IN DEHUMIDIFYING AND OTHERWISE CONDITIONING AIR WITHIN A ROOM

BACKGROUND OF THE INVENTION

Air conditioners and dehumidifiers are widely used. As far as we are aware, however, no such apparatus is suitably versatile for use where the control of the humidity in a room as well as the room temperature must be efficiently and economically maintained at all times and its operation safeguarded against the failure of a component.

THE PRESENT INVENTION

The general objective of the present invention is to provide apparatus which is suitably versatile to satisfy the above generally indicated requirements.

In accordance with the invention, that objective is attainable with apparatus having a cabinet housing first and second units which preferably are identical and are essentially conventional dehumidifiers except that they are mounted in the cabinet side by side with the evaporator and evaporator fan of each unit above its compressor and condenser fan. The cabinet is divided into upper and lower sections.

The cabinet is ported to admit outside air separately to the upper or evaporator and to the lower or condenser sections of the units with the flow of outside air to the upper section controlled by a series of adjustable dampers which are normally closed. Outside air is also admitted to the lower section through a series of normally open adjustable dampers and the apparatus has an outlet port through which air is discharged by the condenser blowers. The cabinet has a conditioned air outlet for each unit which opens into the room and in embodiments where heating is a requirement, a heater is mounted in each conditioned air outlet. The cabinet has room air return ports at each end which open into both sections with the flow of room air into either of them controlled by a series of adjustable dampers. The dampers of the upper series are normally open while the dampers of the lower series are normally closed. The dampers of the several series are pivoted out of and back into their normal positions by a drive which, in practice, includes proportional motors connected to the dampers in a conventional manner and effecting damper adjustments by increments, at least during adjustments away from their normal positions.

With such apparatus, a principal objective of the invention is to provide a control responsive to the relative humidity and temperature of the inside and outside air and operable under a wide range of conditions to establish and maintain the humidity in the room at an acceptable level with the room temperature appropriately regulated.

This general objective, as well as other objectives of the invention and the manner by which they are attained will be apparent from the following summary of principal modes of operation of the components of the two units employing a control responsive to inputs from various temperature and humidity sensors and providing outputs by which the units are operated separately or together or with selected components employed in various combinations.

In one such mode, the economizer mode, the apparatus functions as a ventilator unit. In case the room temperature is too high and the outside air is cooler, the two evaporator fans operate and the adjustable dampers are adjusted to try to establish the temperature of the discharged air within a selected range, say 50° to 54°F. Should the temperature in the room be lower than a selected minimum, and the outside air warmer, the same procedure is followed but with the condenser fans also in use. Under some conditions, a humidity correction would attend economizer operations.

Assuming that operation of the apparatus on an economizer basis fails to lower the room temperature or that the outside air temperature is too high, the apparatus is operated with one unit in service. Should such a first stage operation fail to bring the room temperature down to a selected maximum, second stage cooling is employed with both units operating. When cooled sufficiently by two stage operation, the room temperature can be held from rising by the operation of the first stage unit or even by the economizer.

Assuming that the room temperature is too low, that the conditioned air outlets are each provided with a heater and that the economizer mode fails to elevate the temperature or is not employed, with the adjustable dampers in their normal positions, all fans are operated and one heater is energized. Should the room temperature still be too low, the other heater is also used. Once the room temperature has been raised to an established limit, either first stage heating or even heating on the economizer basis may enable heating demands to be met.

Relative humidity above a selected upper limit is highly objectionable in many instances and, accordingly, a humidistat in the room dictates that the economizer mode be employed if outside ambient conditions are suitable and the relative humidity in the room is too high. If that mode is ineffective, mechanical dehumidification is employed and for that purpose, both condenser fans and compressors are employed but only one evaporator fan is used.

If a higher humidistat level should be reached, all of the dampers are held in their normal positions and the apparatus operates with both compressors and condensers with but one evaporator fan in use.

Another objective of the invention is to provide modes of operation when the room is unoccupied. In accordance with that objective, the air inlet dampers at the first port are then fully closed when the outdoor temperature is high, the economizer mode is not used and mechanical cooling is employed to cool the room temperature to a selected temperature. Should heating be required, the adjustable air inlet dampers are set in their normal positions and either the first, the second stage heating mode or both used.

These and other objectives, novel features and advantages of the invention will be apparent from the accompanying drawings, the following description of the preferred embodiments and the appended claims.

BRIEF DESCRIPTION OF THE DRAWINGS

The accompanying drawings illustrate a preferred embodiment of the invention

THE PREFERRED EMBODIMENT

Figure 1:
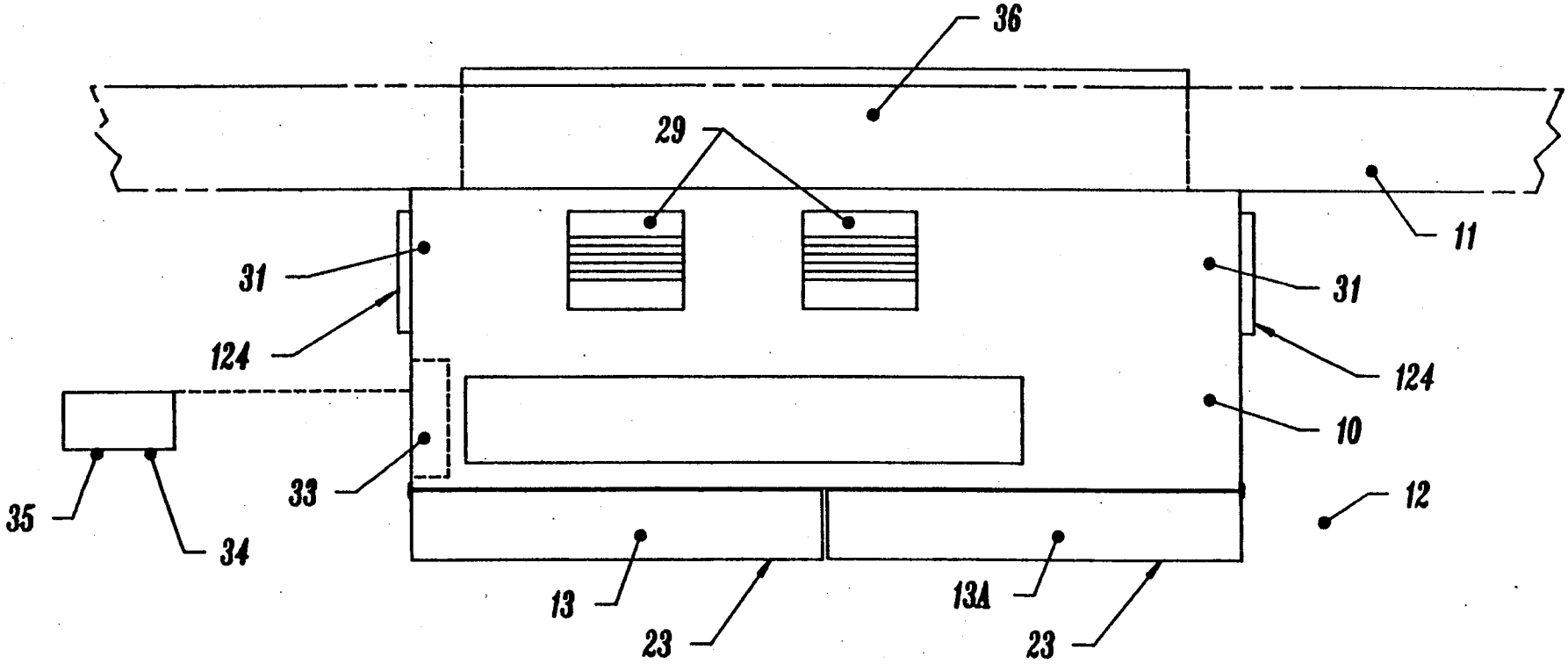
FIG. 1 is a top plan view of an installed apparatus.
Figure 2:
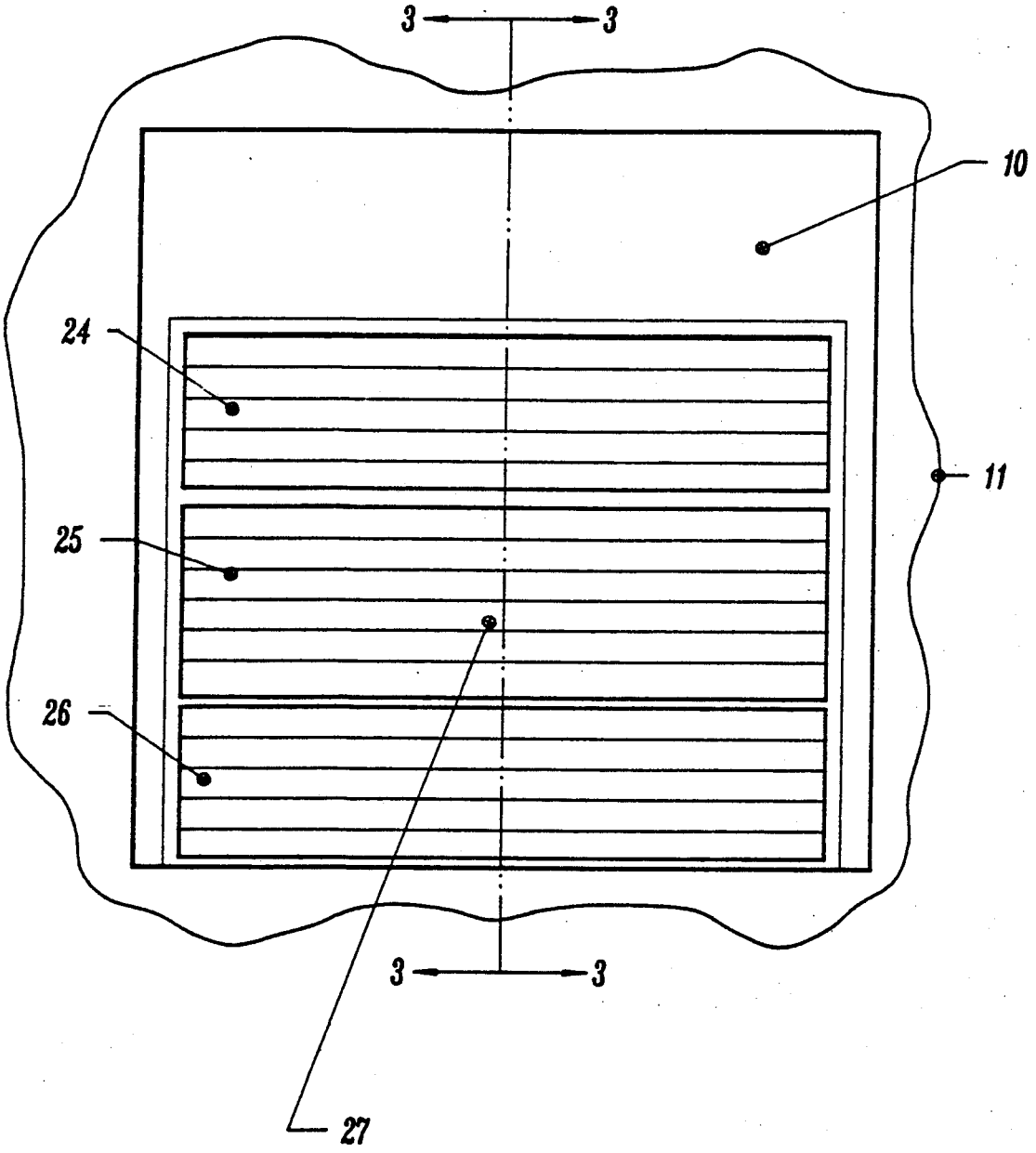
FIG. 2 is a view of the apparatus as seen from the outside.
Figure 3:
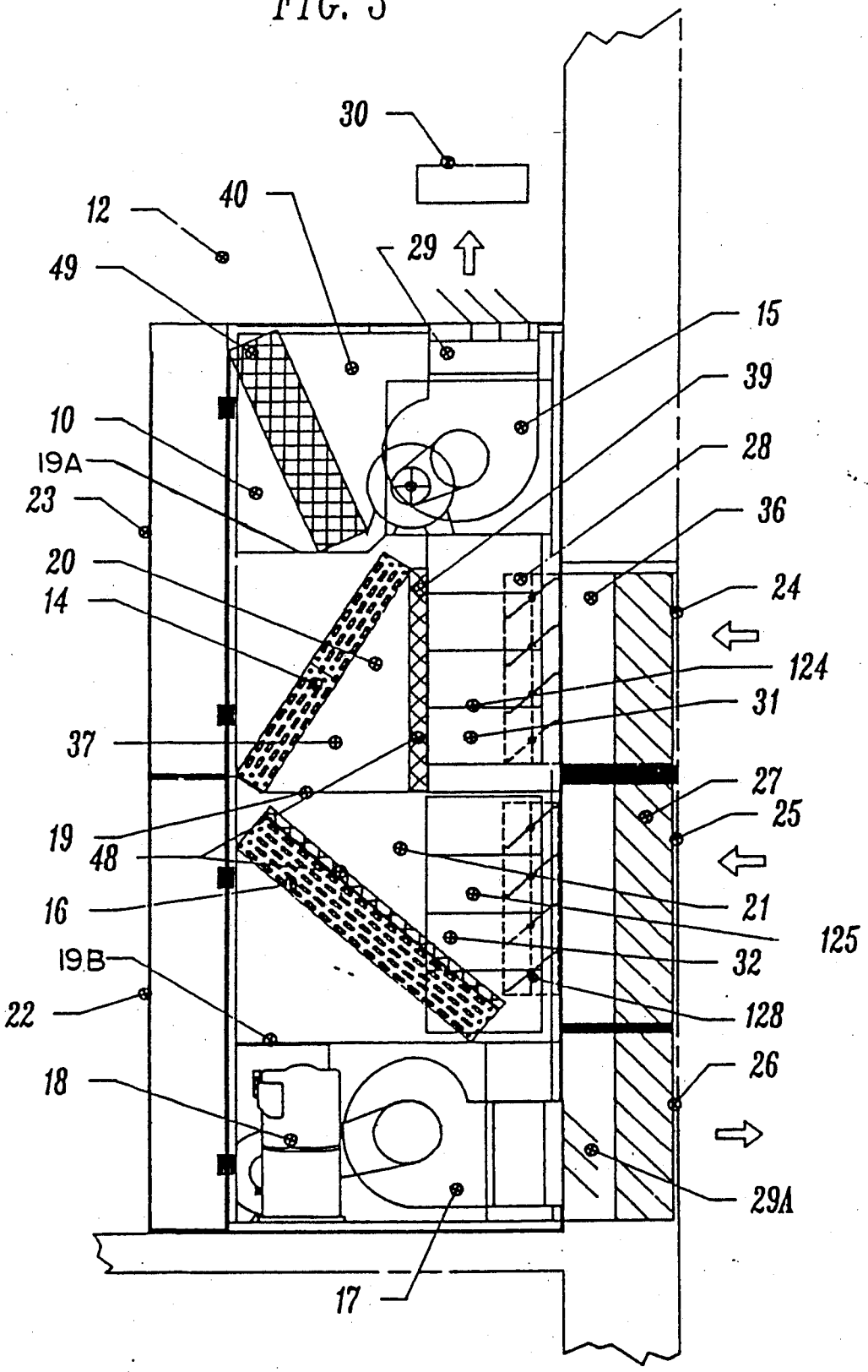
FIG. 3 is a vertical section taken approximately along the indicated line 3—3 of FIG. 2.
Figure 4:
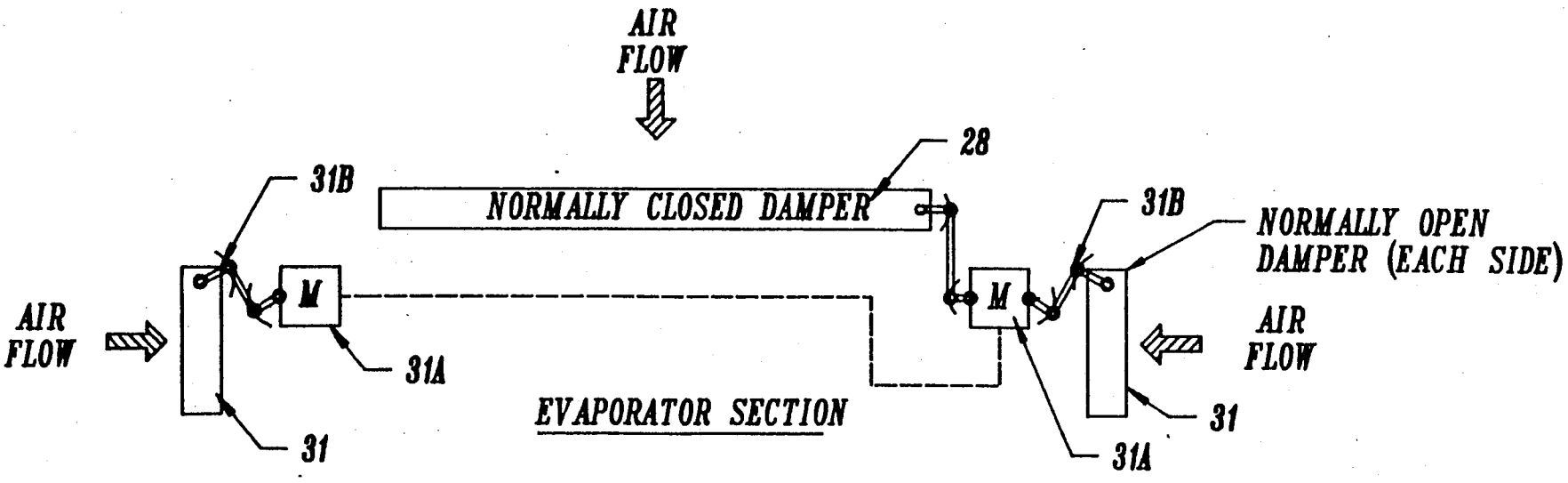
FIG. 4 is a schematic view of the adjustable dampers in control of the flow of outside and room air to the evaporator section of the units.
Figure 5:
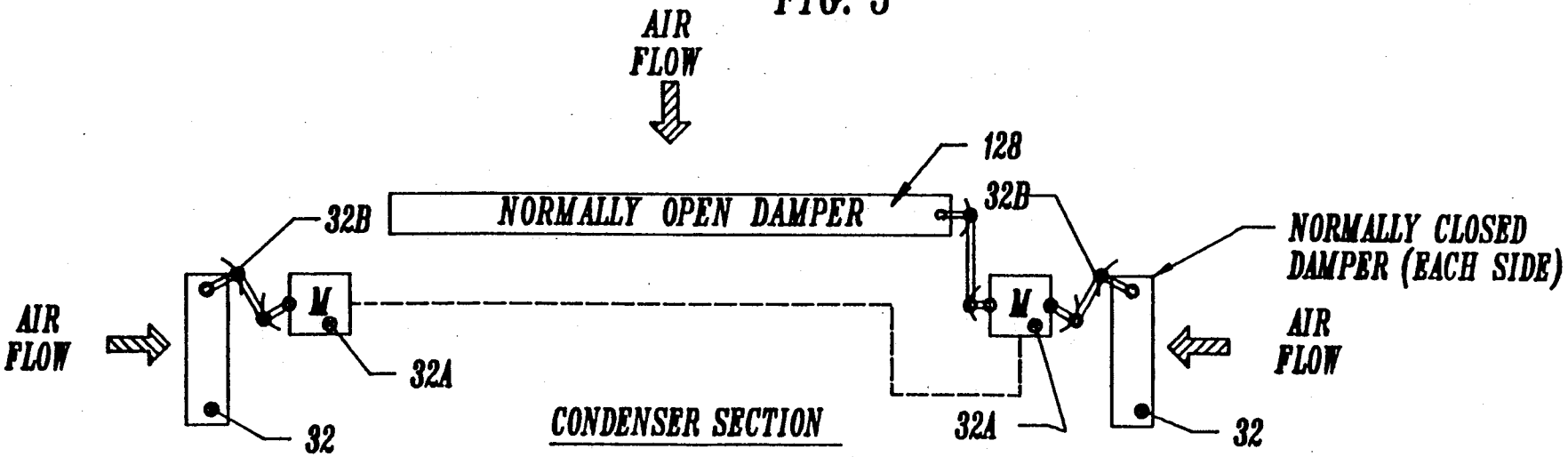
FIG. 5 is a like view of the adjustable dampers controlling the flow of room air into the condenser sections.
Figure 6:
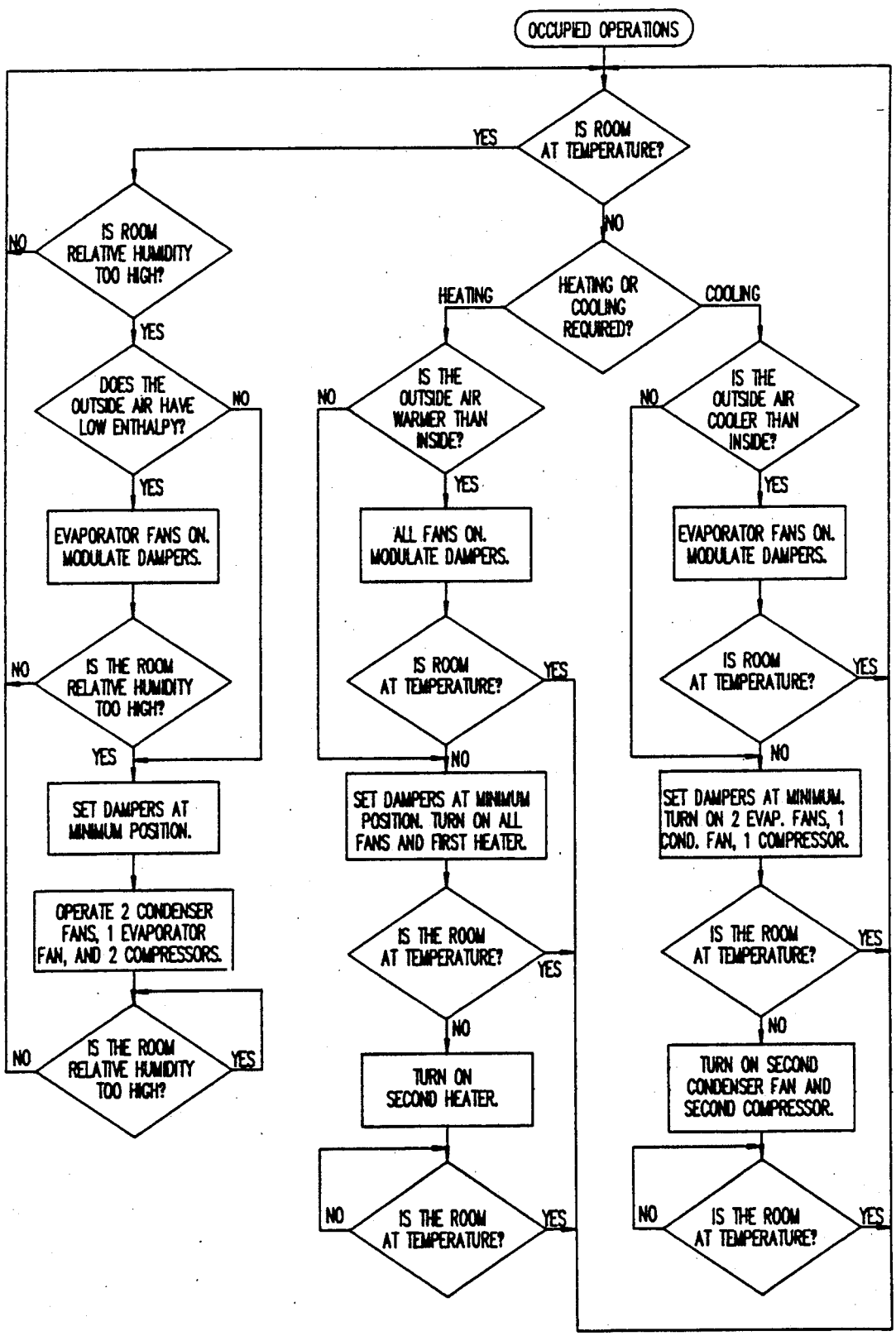
FIG. 6 shows a flow chart of occupied operations.

In FIGS. 1–3 there is shown a cabinet, generally indicated at 10, mounted on the inner surface of an outer wall 11 of a room 12.

The cabinet 10 houses two substantially identical, side by side units, 13, 13A, which are conventional dehumidifiers except that each has its evaporator 14 and evaporator fan 15 above its condenser 16, condenser fan 17 and compressor 18 and separated therefrom by a partition serving as drain pan 19 establishing an upper evaporator section, generally indicated at 20 and a lower condenser section, generally indicated at 21. As such dehumidifying units are well known and in order to simplify the drawings, piping, expansion valves, line filters, accumulators and the like are omitted and the units are not further detailed.

As shown in FIG. 3, a partition 19A separates the evaporators 14 from the evaporator fans 15 and a partition 19B which is also a drain pan separates the condensers 16 from the condenser fans 17. The plenum 22 closes the lower section 21 and provides a vertical air flow passageway about the partition 19B. The plenum 23 similarly closes the upper section 20 and provides a vertical air flow passageway about the partition 19A.

The outer side of the cabinet 10 is provided with three air ports extending through the wall 11. Of the three ports, the port 24 is an air inlet port opening into the upper sections 20, the port 25 is also an inlet port and opens into the lower section 21. The third port 26 is an air outlet port for air discharged by the condenser fans 17. The ports 24, 25 and 26 are screened by fixed baffles 27. An important feature of the apparatus is that the outside air flow through the port 24 is controlled by a series of adjustable dampers 28 which are normally closed and the outside air flow through the port 25 is controlled by a series of normally open adjustable dampers 50.

The top wall of the cabinet 10 has an outlet 29 for each unit through which conditioned air is discharged into the room 12. Each outlet 29 is shown as having an associated conventional electric heater 30 and is provided with back draft dampers 29A.

At each end of the cabinet 10, there are two series of adjustable dampers 31 and 32 controlling, respectively the return flow of room air into the evaporator and condenser sections through ports 124 and 125 in the cabinet end walls. The dampers of the series 31 are normally open while those of the series 32 are normally closed.

In order to control the apparatus to establish and maintain the room temperature and the relative humidity of the air in the room at appropriate levels under a wide range of conditions, sensing means of prevailing inside and outside temperatures and humidity and of the air in the upper section 20 are employed to provide input to a logic panel 33. Of the sensing means, a multi-stage thermostat 34 and a multi-stage humidistat 35 are located in the room 12. An outside temperature and enthalpy sensor 36 is mounted within the cabinet 10 to respond to air conditions returned to the outside by the condenser fan 17 and a mixed air temperature sensor 37 is located between the evaporator 14 and the adjustable dampers 28 and 31.

Each set of adjustable dampers 31 and 28 is adjusted through a predetermined range of positions by means of a proportional motors, the motors 31A. The dampers of the two series of adjustable dampers 32 and 50 are similarly pivoted by means of proportional motors 32A. Like proportional motors are connected to the respective dampers by conventional linkage schematically indicated at 31B and 32B.

There are two bases of operation, one "occupied" operation and the other the "unoccupied" basis. In the former, operation may be one in which room ventilation is effected using fans and the proportional motors to effect damper adjustments to satisfy a wanted room temperature between high and low limits, 68° F. and 78° F. for one example. This basis is referred to herein as the "economizer" mode. Occupied operations also employ cooling and in many installations heating as well. Occupied operations are more detailed in the following section entitled "The Algorithm".

Unoccupied operation does not employ the economizer mode, but utilizes the heating mode with a substantially lower temperature set point, the cooling mode with a substantially higher temperature set point and the same humidity set point as is used for occupied operation.

The Algorithm

The algorithm is concerned with occupied operations and summarizes the various modes of operation required by the logic panel 33 in response to input from the several sensors.

With the power on and the room temperature above the high limit, 78° F. for example, and the outside air cooler, the evaporator fans 15 are energized as are the proportional motors by which the several damper series serving the upper section of the cabinet 10 are adjusted.

If the damper adjustments do not result in the room temperature dropping sufficiently, first stage mechanical cooling is employed. For this stage, the condenser fan 17 and the compressor 18 of one of the units is also energized and if their use does not result in a sufficient temperature drop, second stage cooling is employed in which the compressor 18 and the condenser fan 17 of the other unit is also utilized to ensure that the room temperature is acceptable.

Once the room temperature is thus controlled, it may be managed, if the need for cooling is then sensed by the thermostat 35, by resorting to the economizer mode or, perhaps, to the use of first stage mechanical cooling.

Should the room temperature be too low, below 68° F. by way of example, and the outside air warmer, warming on the economizer basis is tried using all four fans and with the series of dampers serving both sections of the cabinet subject to adjustment.

If the room temperature remains too low, one of the heaters 30 is engaged to effect first stage heating. If first stage heating fails to elevate the room temperature sufficiently, the second heater 30 is energized to ensure the heating demands are met. If room heating is again needed, the use of the economizer mode may enable room temperature demands to be met without reset to first stage heating.

Whenever a high or low level room temperature is met, humidity control may be required. If the humidistat 34 establishes that the relative humidity is too high, its control is first attempted by operating on the economizer basis, if the outside air is drier, with all fans operating and all dampers subject to adjustment by the proportional motors. If the relative humidity remains too high, both compressors 18 and condenser fans 17 are used with only one evaporator fan operating.

The room temperature and humidity is thus established and maintained throughout the occupied period at the end of which the operation of the apparatus shifts to the unoccupied basis.

Figure 7:
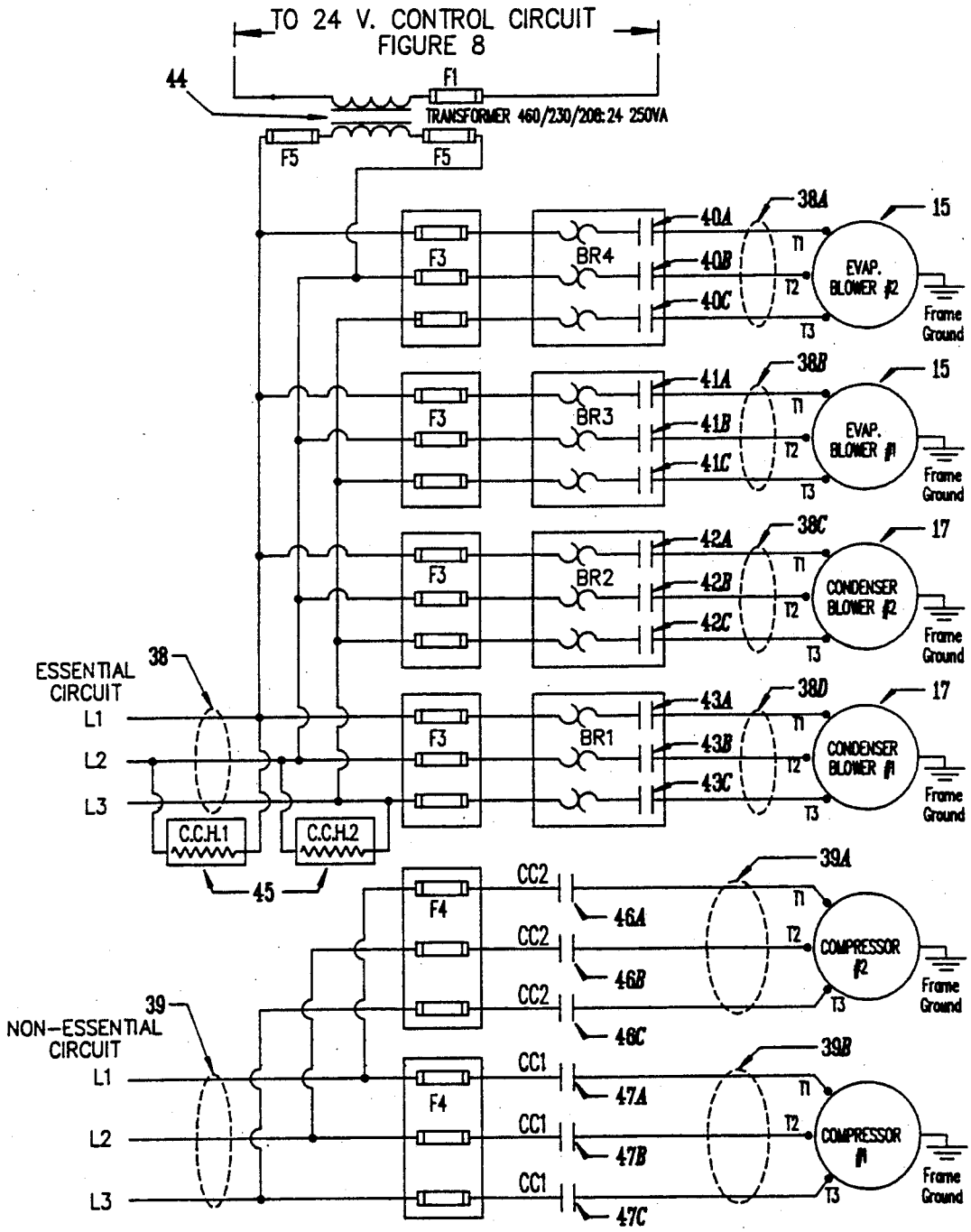
FIG. 7 is a schematic view of the circuitry by which the evaporator and the condenser fans and the compressors are operated.

Reference is now made to FIG. 7 showing supply lines 38 and 39. Each of the two condenser fans or blowers 17 and each of the evaporator fans or blowers 15 is incorporated in the appropriate one of the parallel sections 38A, 38B, 38C and 38D of the line 38 along with the appropriate one of the normally open switches 40A, 41A 42A and 43A of the relays 40, 41, 42, and 43 respectively. Lines 1 and 2 are connected to one side of a transformer 44 while lines 2 and 3 are connected separately to the crankcase heaters 45 of the two compressors 18.

Similarly, each of the two compressors 18 is incorporated in the appropriate one of the parallel sections 39A and 39 of the line 39 along with the appropriate one of the normally open switches 46A, 47A of the relays 46 and 47 respectively.

Figure 8:
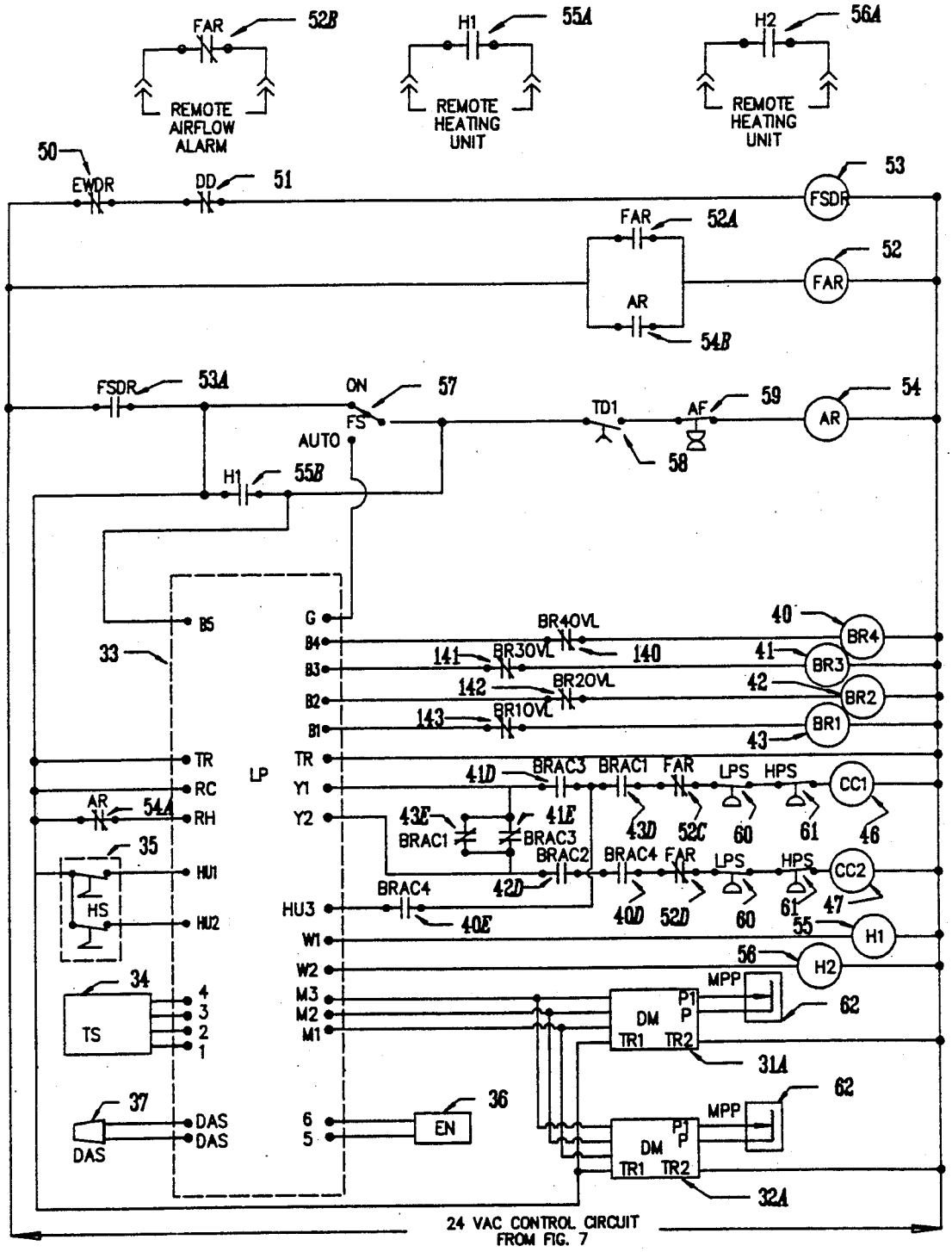
FIG. 8 is a schematic view of the control circuitry.

The other side of the transformer 44, see FIG. 8, is the low voltage portion of the control circuitry. Normally closed contacts 50 (EWDR) and 51 (DD) represent, respectively smoke and fire alarms and are opened by the fan shut down relay 53 (FSDR) if either smoke or fire is present.

If the fan mode switch 57 (FS) is in the "on" position, then terminals B3 and B4 of the logic panel 33 (LP) are energized by its terminal RH all the time to allow the evaporator fans 15 to run constantly provided that the alarm relay 54 (AR) is not energized. If the switch 57 is in its "auto" position, then the terminals B3 and B4 are energized only if terminal G of the logic panel 33 is energized. Terminal G permits the evaporator fans 15 to operate only if a call for heating, cooling or dehumidification exists.

An air pressure switch 58 (AF) with a stated time delay 59 (TDI) ensures proper air flow. If proper air flow is present, the switch 58 opens before switch 59 closes and prevents the fire alarm relay 54 from being energized. If the alarm relay 54 is energized, then the terminal RH is deenergized by the alarm relay 54 thereby preventing the terminals W1 and W2 from energizing the heating relays 55 and 56, the fire alarm relay 54 will then energize a latch preventing the compressor relays 46 and 47 from operating.

Staged heating and cooling calls are provided to the logic panel 33 by the digital thermostat 34 and staged dehumidification calls are provided to the logic panel by the two stage humidistat 35.

Each evaporator fan relays 42, 43 and each condenser fan relay 40, 41 is energized by the appropriate individual terminals B4, B3, B2 and B1 and are protected by overload relays. Terminal Y1 is energized by a call for first stage mechanical cooling and will energize one compressor if the appropriate evaporator fan 15 (proved by the closing of the appropriate one of the relay switches 140, 141) and the appropriate condenser fan 17 (proved by the closing of the appropriate relay switches 142, 143) and if the refrigerant pressures on the suction switch 60 (LPS) and discharge pressure switch (HPS) of that compressor 18 are acceptable. If either fan 15 fails, then the normally open switches 42E, 43E of the other compressor controlling relay will be energized. The Y2 terminal provides the second stage cooling call for the second compressor.

The terminal hub of the logic panel 33 will energize the first compressor relay 48 on a demand for dehumidification if relay switch 40E is closed then permitting both compressors and condenser fans to operate with but one evaporator fan in use.

The damper activators (DM) are controlled by the M1, M2 and M3 terminals of the panel 33 which are, in turn, controlled by the discharged air sensor (DAS). The minimum position setting of the dampers is controlled by the minimum position potentiometers (MPP). The enthalpy controller (EN) tests the temperature and humidity of the outside air and provides the appropriate input or signal to the logic panel 33.

From the foregoing both the construction of the apparatus and its operation in controlling and maintaining the temperature and humidity on an economical basis will be readily understood.

We claim:

1. Apparatus for dehumidifying and otherwise conditioning the air in a room, said apparatus including a cabinet in the room at the inner side of a wall thereof, two dehumidifier units mounted side by side in the cabinet, each unit having a compressor, condenser, evaporator, condenser fan and evaporator fan, (with) the evaporator and evaporator fan of each above the condenser, condenser fan and compressor thereof, drain pan means below the evaporators and dividing the (units) cabinet into upper and lower sections, a partition separating the evaporators from the evaporator fans, a partition separating the condensers from the condenser fans, said cabinet provided with first, second and third ports opening through the other side of the wall, the first (and second) (port) (ports) port opening into the upper section, the (third) (second) second port opening into the lower section, the first and second ports for the admission of air into the cabinet and the third port for the discharge of air from the condenser (fan) fans, a conditioned air outlet for each unit in the top of the cabinet, and inlet ports in each end of the cabinet to receive air from the room and opening into both sections, separate plenum means, one for each section attached to the cabinet and opening into (both sections) the appropriate section to provide a vertical passageway (between the sections) about the partition therein, a series of normally closed pivotable dampers mounted in the cabinet and operable to control the admission of air through the first port into the upper section, a series of normally open pivotable dampers at each end of the cabinet and operable to control the admission of air from the room into the lower section, means operable to adjust the dampers of each series by turning them from and returning them to their normal positions, at least the adjustments away from their normal positions by increments, humidity and temperature sensing means responsive to the humidity and temperature on both sides of the wall and control means responsive to the sensing means and operable to establish and maintain wanted humidity and temperature conditions within the room by controlling the operation of the units, components thereof and the means by which the several series of dampers are adjusted.

2. The apparatus of claim 1 in which the damper adjusting means includes proportional motors, one adjacent each end of both cabinet sections, the motors in each section slaved to operate in unison, each motor connected to the dampers of the proximate in a manner to effect their pivoting, one of the motors in the upper section also connected to the dampers of the series for the first port in a manner to effect their pivoting.

3. The apparatus of claim 1 and air filtering means between the evaporator and the evaporator fan of each unit.

4. The apparatus of claim 1 in which the control means is a logic panel wired to respond to inputs from the sensing means and provide outputs effective to control the operation of the proportional motors, the fans and the compressors.

5. The apparatus of claim 4 in which the logic panel respond to inputs from the sensing means representing the need for the room to be cooled and inputs establishing that the outside air is suitable for room cooling and the panel outputs effect the energization of the evaporator fans and the proportional motors until the temperature of the air in the upper section is in a range indicative of an acceptable room temperature.

6. The apparatus of claim 5 in which the sensing means inputs still represent that the room temperature remains too high and the panel output also effects the energization of the compressor and the compressor fan of one of the units.

7. The apparatus of claim 6 in which the sensing means input represents that the room temperature is still too high and the resulting panel output now effect the energization of the compressor and compressor fan of the other unit.

8. The apparatus of claim 4 in which the sensing means input to the panel establish that the room temperature is too low and that the outside air is suitable for use in warming the room, and the panel outputs effect the energization of all four fans and the proportional motors until the temperature of the air exhausted from the apparatus by the condenser fans is substantially that wanted for the room.

9. The apparatus of claim 8 in which there is a heating unit in each conditioned air outlet and the sensing means input to the panel establishes that the room temperature is still too low and the panel outputs then effect the energization of one heater thereof and the energization of the proportional motor in the upper section to return the series of dampers for the first port into their normally closed positions.

10. The apparatus of claim 9 in which the sensing means input to the panel establish that the room temperature is still too low and the panel outputs then effect the energization of the other heater.

11. The apparatus of claim 4 in which the sensing means inputs to the panel establish that the relative humidity in the room is above a first high limit and that the outside air is drier and the panel outputs then effect the energization of all four fans and the modulation of the dampers of all series until the relative humidity of the air exhausted from the apparatus represents a relative humidity suitable for the air in the room.

12. The apparatus of claim 11 in which the sensing means input to the panel establishes that the relative humidity of the air in the room remains too high and the panel outputs then also effect the energization of both compressors and condenser fans and one evaporator fan.

13. The apparatus of claim 4 in which the sensing means input to the panel establish that the relative humidity in the room is still too high and the panel outputs effect the placing of the series of dampers in the upper section in their normal positions and the energization of both compressors and the condenser fans and one evaporator fan.

* * * * *